United States Patent [19]

Phillips et al.

[11] 4,090,908

[45] May 23, 1978

[54] APPARATUS FOR MAKING WATER BED MATTRESSES

[76] Inventors: Raymond M. Phillips, 2566 S. Tuna Canyon Rd., Malibu, Calif. 90265; William J. Pease, 3537 Bagley Ave., Los Angeles, Calif. 90034

[21] Appl. No.: 794,941

[22] Filed: May 9, 1977

Related U.S. Application Data

[62] Division of Ser. No. 636,696, Dec. 1, 1975.

[51] Int. Cl.[2] ..... B32B 19/02; B32B 31/00

[52] U.S. Cl. ..... 156/380; 156/581

[58] Field of Search ..... 156/380, 581

[56] References Cited

U.S. PATENT DOCUMENTS

| | | | |
|---|---|---|---|
| 2,422,979 | 6/1947 | Pecker | 156/380 |
| 2,542,702 | 2/1951 | Prow | 156/380 |
| 2,816,596 | 12/1957 | Welch | 156/380 |
| 3,360,417 | 12/1967 | Peterson et al. | 156/380 |
| 3,580,780 | 5/1971 | Klawunn et al. | 156/380 |
| 3,886,027 | 5/1975 | Hoffmann | 156/380 |

*Primary Examiner*—Douglas J. Drummond
*Attorney, Agent, or Firm*—Robert J. Schaap

[57] ABSTRACT

A water bed mattress comprised of upper and lower flexible foldable sheets which are essentially rectangular in shape. The upper sheet is essentially formed by folding up portions of the lower sheet upwardly and inwardly and transversely sealing end margins of the folded up portions, and also thereby creating two peripheral transversely extending side wall sections. In addition, longitudinal end portions of the upper and lower sheets are also folded downwardly and upwardly, respectively, and sealed to each other to thereby form longitudinally extending side wall sections, and which, together with the upper and lower sheets, create an internal water chamber. In the making of the water bed mattress, end cut-outs are formed in the sheets. Moreover, insert panels are heat-sealed to the interior portions of the side wall sections to cover these cut-outs and thereby seal the interior of the mattress. In accordance with this construction, a water bed mattress can be formed with a minimum amount of material and which creates less seaming area and locates the corner areas in a position away from the frame which supports the water bed mattress. The present invention also provides a method and an apparatus for making the water bed mattress.

5 Claims, 12 Drawing Figures

APPARATUS FOR MAKING WATER BED MATTRESSES

RELATED APPLICATIONS

This application is a division of U. S. application Ser. No. 636,696, filed Dec. 1, 1975, for WATER BED MATTRESS.

BACKGROUND OF THE INVENTION

This invention relates in general to certain new and useful improvements in water bed mattresses and the method and apparatus used in making the same, and, more particularly, to improved water bed mattresses and the method and apparatus used in making the same, which are constructed with a unique seam construction to thereby minimize the seaming area and stresses on the mattress.

In recent years, water beds have become widely commercially acceptable and have found substantially increased use. It is now being fairly well recognized that water beds, that is those forms of beds which employ a water-filled mattress, have not only enjoyment value, but therapeutic value as well. In general, it has been found that many people find that it is not only more enjoyable, but is more restful to sleep on a water bed mattress than other forms of conventional mattresses filled with solid, but nevertheless resilient, material.

Due to the increased acceptance of water beds, there have been a number of proposed techniques in the construction of these water beds and in the proposed techniques for the manufacture of such water beds. One of the primary problems involved is the sealing of the components of the water bed mattress, which normally comprise vinyl plastic components in such manner that they will not yield under stress. Moreover, it has been found in connection with the manufacture of such water bed mattresses that a substantial amount of waste material results, particularly in the formation of the corner margins in the rectangularly shaped water beds. Notwithstanding, in order to form the corner margins, some manufacturers have resorted to pleating and like gathering of materials in order to hopefully reduce the stresses on the corner margins. Nevertheless, the typical techniques used in the manufacture of water beds also require a substantial amount of manual labor which thereby lends to an increase in the cost of such mattresses.

The present invention obviates these and other problems in the provision of a water bed mattress which is constructed of a pair of upper and lower sheets with a pair of transverse side walls being formed by forming the lower sheets into upper panels and sealing the upper panels to form the upper sheet. Moreover, longitudinal side flaps on the upper and lower sheets are struck downwardly and upwardly, respectively, in order to form the longitudinal side wall sections.

In addition, cut-outs are formed in the longitudinal side walls and panels are lap-sealed to the side wall sections having these cut-outs as well as to the adjacent side wall sections. In this way, it is possible to manufacture the water bed on a relatively simple basis involving a minimum amount of manual labor and a minimum amount of waste material.

It is therefore the primary object of the present invention to provide a water bed mattress which is formed with improved corner margins by unique use of lap-sealing and which thereby eliminates possible stress on the seams of the mattress and thereby increases the longevity of the mattress.

It is another object of the present invention to provide a water bed mattress of the type stated which utilizes a minimum of seam welds and thereby substantially reduces the possibility of leakage problems.

It is a further object of the present invention to provide a water bed mattress of the type stated which is highly durable in its construction and provides a safety feature substantially greater than other forms of conventional available water bed mattresses.

It is also an object of the present invention to provide an apparatus to aid in the formation of unique corner margins in water bed mattresses.

It is another salient object of the present invention to provide a method of making a water bed mattress of the type stated which is highly efficient in its operation and requires a minimum amount of manual labor.

With the above and other objects in view, my invention resides in the novel features of form, construction, arrangement and combination of parts presently described and pointed out in the claims.

BRIEF DESCRIPTION OF THE DRAWINGS

Figure 1:
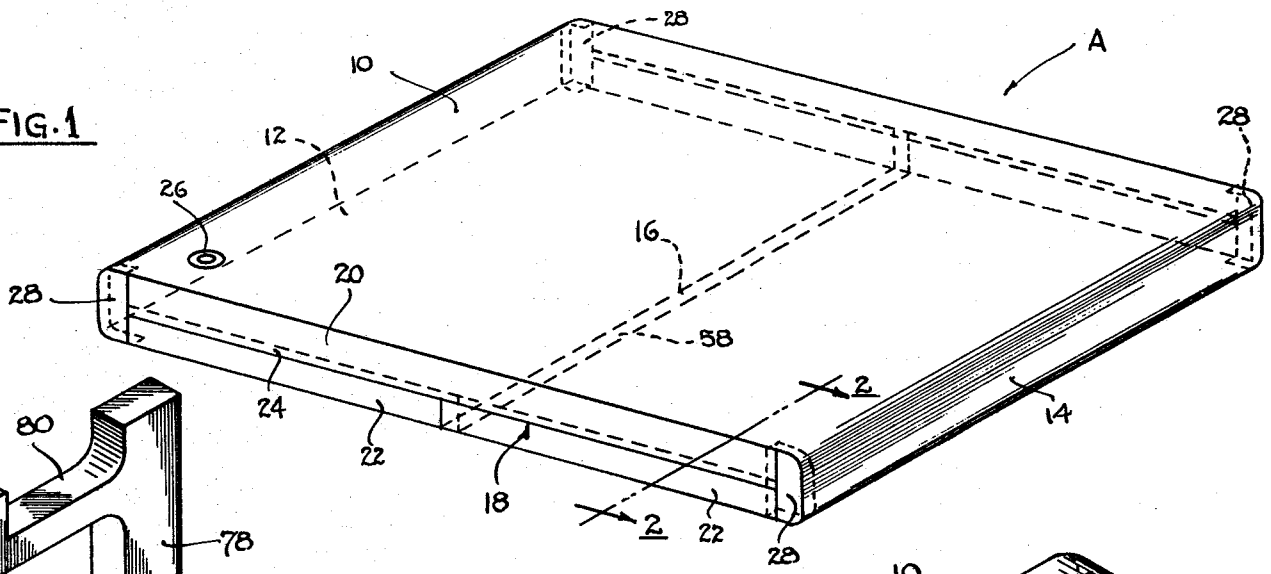
Figure 2:
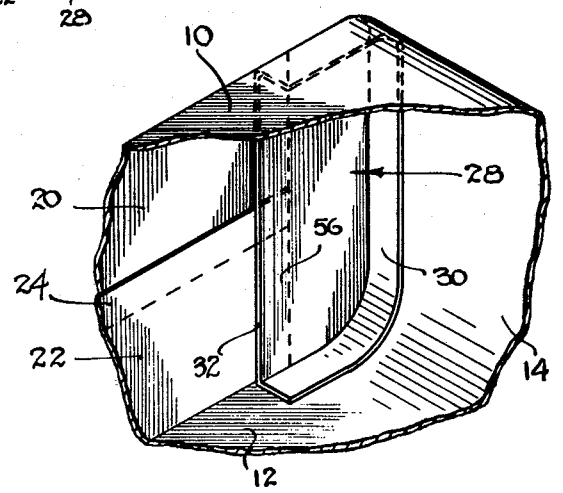
Figure 12:
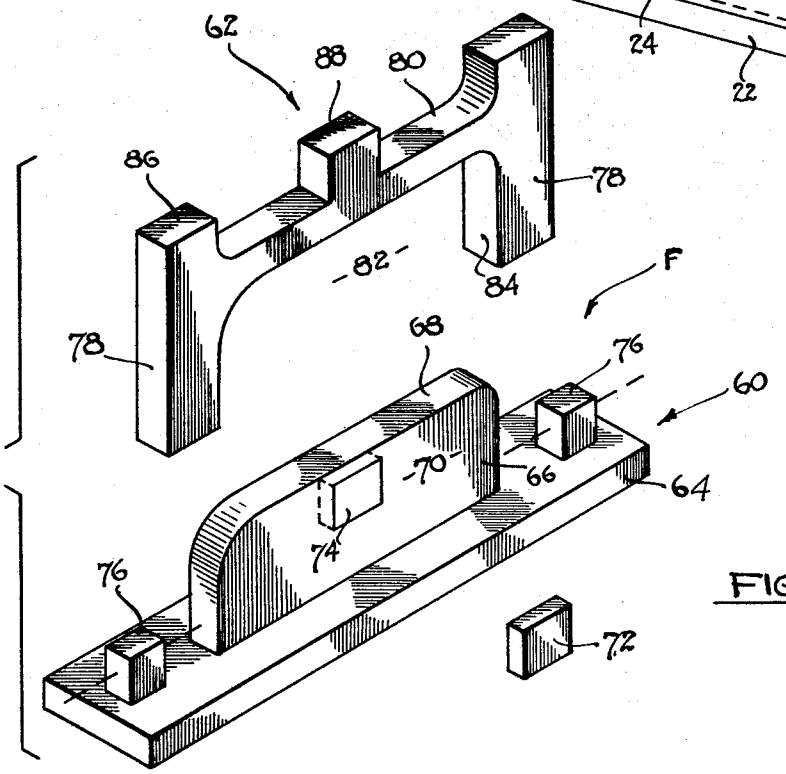
Figure 3:
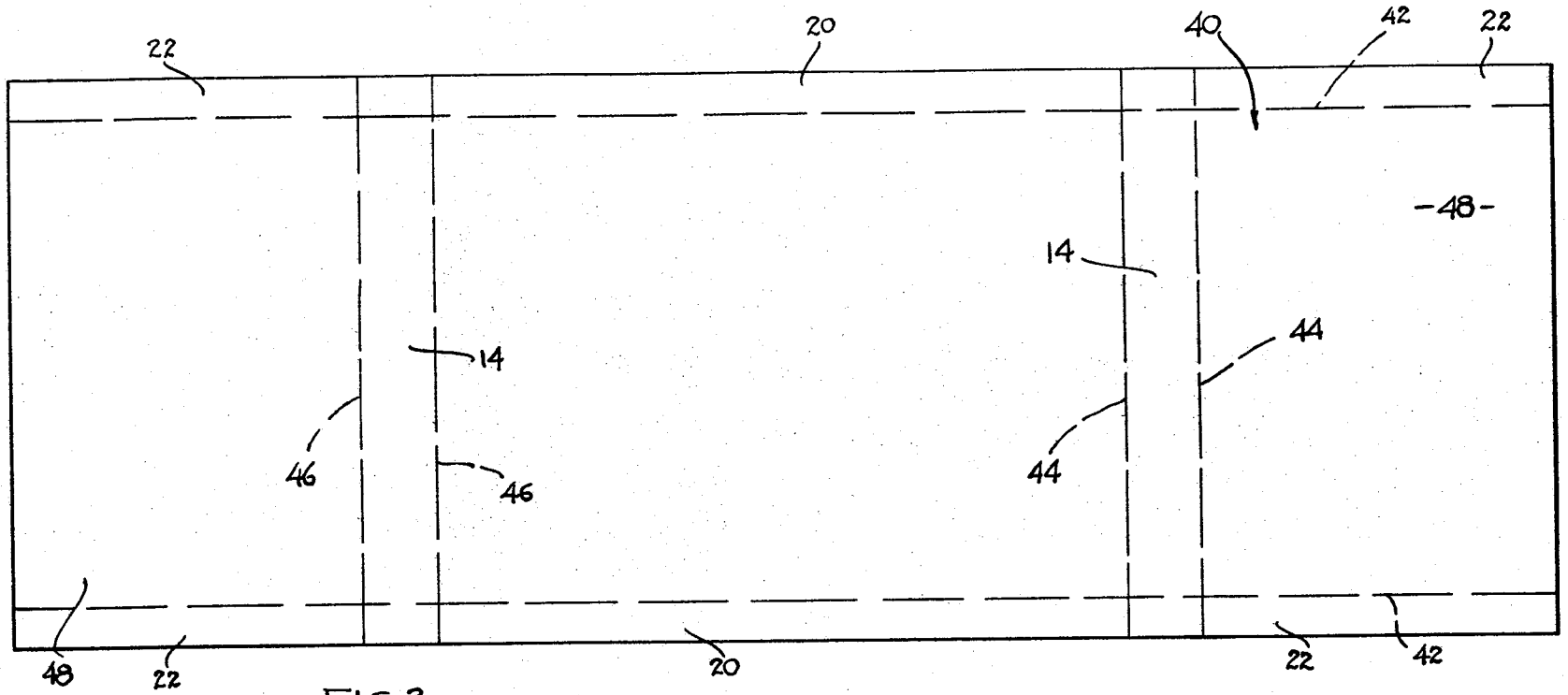
Figure 5:
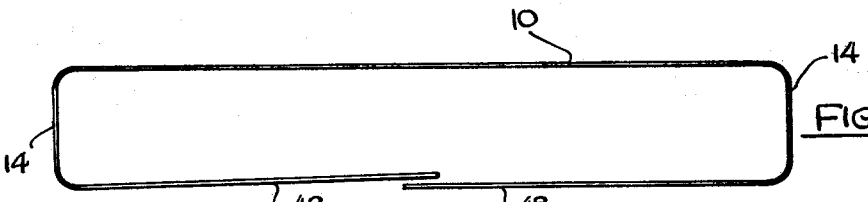
Figure 11:
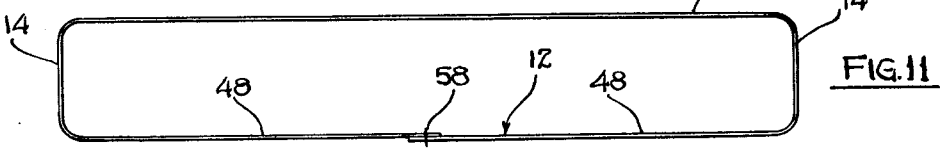
Figure 7:
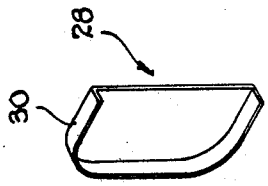
Figure 6:
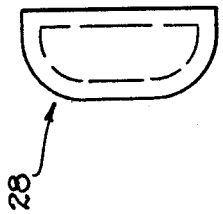
Figure 4:
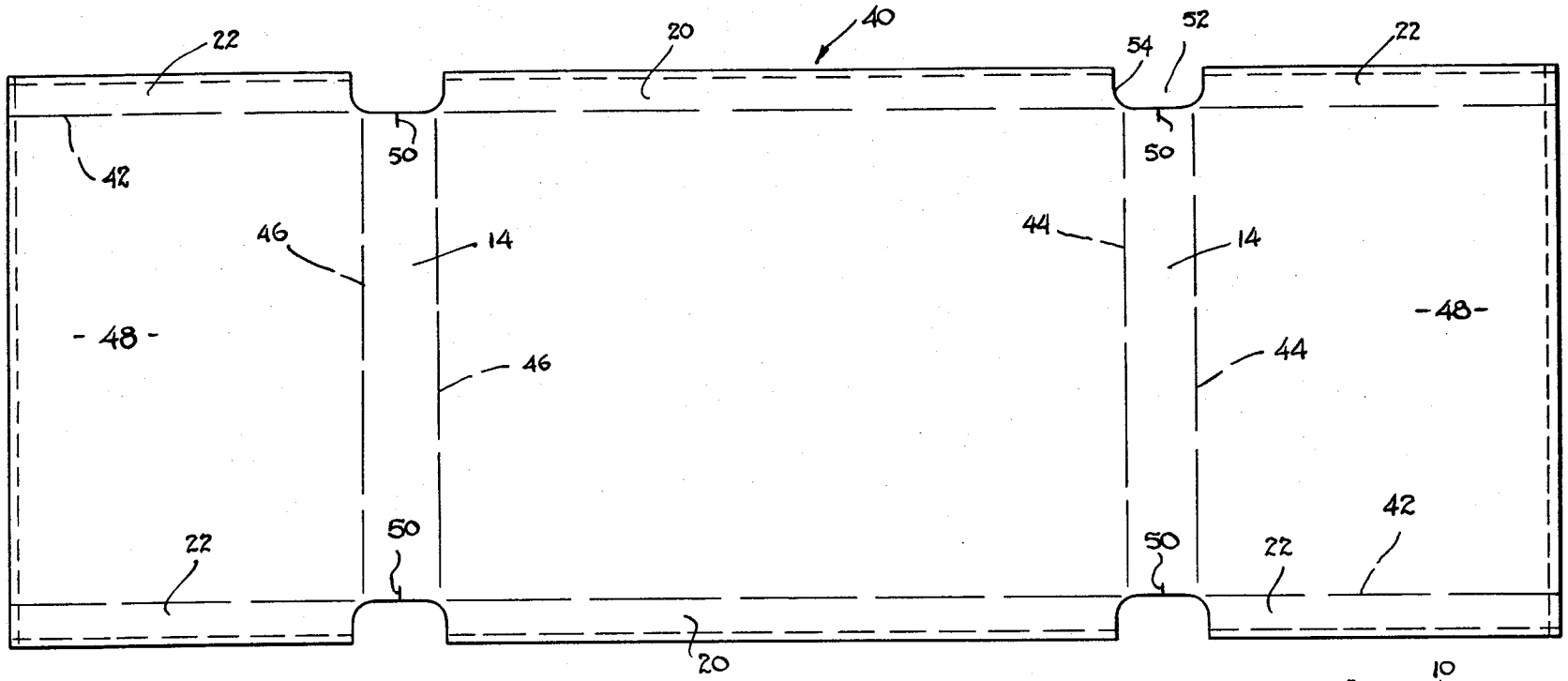
Figure 8:
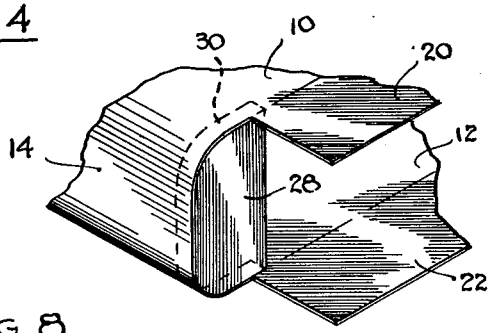
Figure 9:
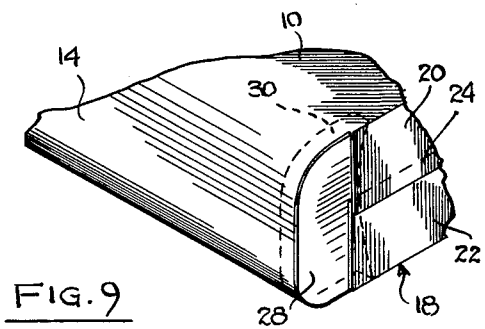
Figure 10:
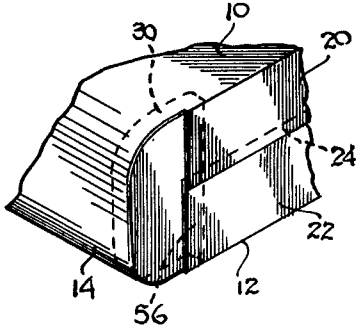

Having thus described the invention in general terms, reference will now be made to the accompanying drawings in which:

FIG. 1 is a perspective view, partially in section, and showing a water bed mattress constructed in accordance with and embodying the present invention;

FIG. 2 is a fragmentary perspective view taken substantially along line 2—2 of FIG. 1;

FIGS. 3–11 not only further illustrate the water bed mattress of the present invention, but also illustrate several of the method steps used in the making of the mattress and in further detail:

FIG. 3 is a top-plan view, partially shown with phantom lines, of a flat sheet which is used in the construction of a water bed mattress;

FIG. 4 is a top plan view, partially shown in phantom lines which represent fold lines, of the same sheet of FIG. 3 with several cut-outs formed therein;

FIG. 5 is an end elevational view of the sheet of FIGS. 3 and 4 folded over to form top and bottom walls;

FIG. 6 is an end elevational view of an insert flap which is used in the construction of the mattress of the present invention;

FIG. 7 is a perspective view of the insert flap of FIG. 6 showing terminal flanges thereon;

FIG. 8 is a fragmentary perspective view, partially shown in phantom lines, and illustrating the sealing of the insert flap of Figure to the sheet which has been folded over;

FIG. 9 is a perspective view, similar to FIG. 8, and showing the sealing of longitudinal flaps in order to form longitudinal side wall sections;

FIG. 10 is a fragmentary perspective view, somewhat similar to FIG. 9, and showing the sealing of the insert flap to the thus-formed longitudinal side wall sections;

FIG. 11 is an end elevation view, somewhat similar to FIG. 5, and showing two lower bottom wall flaps with a transverse seal to thereby form a water chamber; and FIG. 12 is a perspective view showing several components which form part of an apparatus used in the construction of the water mattress.

DETAILED DESCRIPTION

Referring now in more detail and by reference characters to the drawings which illustrate practical embodiments of the present invention, A designates a water bed mattress comprising an upper flexible plastic sheet 10 and a lower flexible plastic sheet 12, and both of which are substantially orthagonal, and preferably rectangular in their construction, but also preferably with rounded corner margins.

The upper sheets 10 which serves as a top wall is connected to the lower sheet 12 along its transverse end margins by means of transversely extending side wall sections 14 which are integral with the upper sheet 10 and the lower plastic sheet 12. In this case, the lower plastic sheet 12 also serves as a bottom wall. Moreover, the lower plastic sheet 12 actually is formed of two inwardly struck bottom wall panels extending from the side wall sections 14 and which are heat-sealed by a transverse heat seal designated by reference numeral 16.

The water bed mattress A is also provided with a pair of longitudinal side wall sections 18 in the manner as illustrated in FIGS. 1 and 2 of the drawings. In this case, the longitudinal side wall sections 18 are formed by means of a downwardly struck flap 20 on each of the longitudinal side margins of and are integral with the upper sheet 10, and upwardly struck flaps 22 which are integral with and extend longitudinally along the two panels which form the bottom or lower sheet 12. Moreover, each of the downwardly struck flaps 20 and the upwardly flaps 22 are lap-sealed along their longitudinally common margins by means of a lap-seal designated by reference numeral 24, and as more fully illustrated in FIG. 2 of the drawings.

The upper sheet 10 may also be provided with a suitable valve 26 which is essentially conventional in the construction of water bed mattresses, and it will therefore not be described or illustrated in any further detail herein. These valves 26 are designed to permit the filling and removal of water into the interior chamber formed within the water bed mattress.

In order to form corner sections, as illustrated in FIG. 2, without the necessary pleating normally resulting from this form of construction, the water bed mattress is provided with a panel insert, designated by reference numeral 28, which extends over apertures at each of the opposite ends of each of the longitudinal side wall sections 18. In this case, each of the insert panels 28 are provided with inwardly struck terminal flanges 30 for lap-sealing to the respective top wall 10 and the bottom wall 12 and the transverse side wall sections 14, in the manner as illustrated in FIG. 2 of the drawings. Moreover, the insert panel 28 is also provided with a vertical lap seal 32 to seal the inner end of the insert panel 28 to the longitudinal side wall sections, in the manner as illustrated.

As indicated above, FIGS. 3–11 also show portions of the details of construction of the water bed mattress A and also illustrate the sequence of method steps used in the manufacture of the water bed mattress. Reference numeral 40 illustrates a flat sheet having a length approximately equal to the total longitudinal dimension of the top wall and the bottom wall and the overall height of each of the transverse side wall sections 14. Moreover, the flat sheet 40 is provided with longitudinally extending fold lines designated by reference numeral 42, on each of the opposite transverse sides thereof to thereby create the upwardly and downwardly struck longitudinal flaps 20 and 22. In addition, the sheet 40 is provided with a first pair of transversely extending fold lines 44 located toward one transverse end margin of the sheet 40, and another pair of transversely extending fold lines 46 located near the other opposite end margin of the sheet 40. These transversely extending fold lines 44 and 46, and more particularly the area between each fold line of the pairs, form the respective transversely extending side wall sections 14. In addition, the outermost fold line of each of the pairs of fold lines 44 and 46 define the two inwardly struck lower panels designated by reference numerals 48, which thereby form the bottom sheet 12.

After the sheet 40 is laid out in a relatively flat position on a table or similar support surface, which has been cut to a proper length, four rectangularly located indicia marks, designated by reference numeral 50, are marked on the upper surface of the sheet 40. These indicia marks represent the desired location for removing portions of the sheet and thereby create four rectangularly spaced cut-outs 52 which may be provided with somewhat rounded corner margins 54 on the inner portions thereof. Moreover, it can be observed that these cut-outs 52 transversely span the first pair of transversely extending fold lines 44 and the second pair of transversely extending fold lines 46.

As the next step in the making of the water bed mattress, the inwardly struck panels 48 which ultimately form the bottom wall 12 are folded inwardly around the respective fold lines 44 and 46. In this case, the panels 48 are folded inwardly in upwardly spaced apart relationship with respect to the sheet 40. However, ultimately, this structure including these panels are inverted to form the bottom wall. FIG. 5 illustrates the panels 48 folded and aligned with the transverse terminal margins lying in juxtaposition to one another but not having been end sealed.

After the sheet 40 is folded in the position as illustrated in FIG. 5, the four insert panels 28 are then connected to the folded sheet 40 in the region of the cut-outs 52. By reference to FIGS. 4 and 6 of the drawings, it can be seen that the panel 28 and the cut-outs 52 essentially have a similar shape. However, the size of the cut-outs 52 is slightly larger than the panels 28, in the initial unfolded condition. In addition, the cut-outs 52 could be essentially rectangular in shape whenever the insert panels 28 have rounded corner margins. The insert panels 28 are initially provided with an inwardly struck flange 30 along a portion of its periphery. When the sheet 40 is folded in the position, as illustrated in FIGS. 8–10, it can be observed that each particular cut-out 52 assumes essentially the same overall size and shape as the flat portion of insert panel 28. Moreover, the flange 30 extends along a portion of what is then the top wall 10 and a portion of the bottom wall 12, as well as a portion of the associated transversely extending side wall sections 14. In such position, the flange 30 is then sealed to these respective portions of the sheet 40. Moreover, by simple observation to FIGS. 8–10, it can be observed that the sealing between the insert panel 28 and the sheet 40 assumes that of a lap seal. Moreover, and in this same respect, it can be observed that each of the four insert panels 28 would be located and sealed to the sheet 40 at a respective one of each of the cut-outs 52.

After each of the insert panels 28 have been heat-sealed in their position, the longitudinal side flaps 20 on each of the opposite sides of the top wall 10 are folded downwardly and, similarly, the longitudinal flaps 22 on the lower panels which form the bottom wall 12 are struck upwardly. Thereafter, a metal bar serving as an RF conductor is inserted in the interior portion of the mattress being formed. In this respect, it can be observed that one of the longitudinal flaps 20 or 22 will overlie the other of the longitudinal flaps. In this case, the two flaps are then lap-sealed to each other on each of the opposite sides of the mattress to thereby complete the formation of the side wall components. After formation of the two longitudinal side wall sections, the steel conductor can be removed from the apertures still existing between the longitudinal side wall sections and the insert panels.

After the longitudinal side wall sections have been formed, as described in connection with FIG. 9, the end margins of the longitudinal side wall sections are then heat sealed to the inwardly presented end of the insert panel 28 and are heat-sealed along a vertical heat seal designated by reference numeral 56. In this way, the formation of a completely enclosed peripheral side wall is achieved. In this last respect, it should be observed that the RF conductive bar which is used in the formation of the vertical lap seal 56 on each of the four corners of the mattress can be removed between the opening existing between the two inwardly struck panels 48 to form the bottom wall 12.

As a final step in the formation of the water bed mattress, the two inwardly struck panels 48 are then heat-sealed by means of a lap-seal 58, as more fully illustrated in FIG. 11 of the drawings. In this respect, it can be observed that the free margins of the inwardly stuck panels 48 overlap with respect to each other to thereby enable the formation of a lap seal. The metal RF conductor which is used in the formation of the lap seal, and which would of course be located on the interior of the mattress, can be easily removed through the valve opening 26.

One of the unique aspects of the water bed mattress of the present invention is that by using the insert panel 28 within the cut-out portions of the sheet it is possible to form the water bed mattress without the excessive material which would normally gather at the corner portions of a rectangularly shaped mattress. Moreover, and in other constructions, some previous attempts to obviate this problem have relied upon the formation of pleats to overcome the inadvertent and otherwise uncontrolled gathering of the plastic material. However, the formation of pleats only controls the problem of gathering material, but nevertheless did create substantial heat sealing problems and had a tendency to result in substantial danger of leakage by virtue of ineffective sealing. The use of the insert panels is also highly unique in that it enables a water bed mattress to be constructed from a single sheet of unrolled plastic material and which has almost virtually eliminated the problem of waste of plastic sheet material, which is otherwise considerably high in the manufacture of water beds. In this respect, the insert panels 28 can actually be formed from the portions of the plaxtic sheet removed at the cut-outs 52. Hence, a complete water bed mattress can be made with one unrolled sheet of plastic material.

The water bed mattress of the present invention, and one constructed by the method herein, is also highly advantageous in that the seamed edges are actually removed somewhat from the corner portions of the frame which holds the water bed mattress. Consequently, there is less likelihood of inadvertent damage to the seams, a problem which exists with respect to conventional water bed mattress. Thus, the water bed mattresses of the present invention provide a substantially increased safety factor when compared to such other conventional forms of water bed mattresses. One of the other unique advantages of the water bed mattress of the present invention is that they provide a substantially increased fit with respect to a surrounding support frame.

While vinyl plastics are used in the formation of the water bed mattresses of the present invention, other forms of plastic material may be used and include polyethylene, polystyrene, polybutadiene copolymers and other resinous substances which can be made in the form of plastic sheets, but which nevertheless have the qualities of being foldable and flexible. While the materials mentioned above are thermo-plastics in nature, it should be understood that many thermo-setting resins could also be used. In addition, various flexible non-plastic materials could also be employed, as for example, various textile materials which are water impervious and which may be plastic impregnated, such as those cloth materials which are impregnated with a vinyl plastic material and which render the same water impervious. The upper and lower sheets, as well as the peripheral side wall, should preferably have a thickness of no less than 20 mils. However, the desired thickness may be predicated upon the overall size of the mattress itself.

FIG. 12 illustrates an apparatus which may be used in the formtion of the corner portions of the mattress of the present invention. The apparatus, which is designated by reference numeral F, comprises a base fixture 60 and a retaining fixture 62. In this case, the base fixture 60 includes a base plate 64 and an upstanding forming block 66 constituting a first die forming member. The forming block 66 has an outer peripheral side wall 68 which has a shape essentially conforming to the inturned flange 30 on the insert panel 28. In essence, the inturned flange 30 is actually formed on the forming block 66 by means of the peripheral surface 68. The flat portion of the insert panel 28 is then located against one flat face 70 or flat wall of the forming block.

The insert panel may also be retained on the forming block 66 by means of a magnet 72. In this case, the forming block 70 could be formed of a magnetic material which couples with the magnet 72 or, otherwise, an individual magnet 74 could be located in the flat face 70 of the forming block 66. The magnet 72 would hold the insert panel on the face 70 by means of a magnetic attraction to the forming block 70. Moreover, the vertically disposed portions of the inwardly struck flange 30 on the insert panel 28 are retained on the forming block 66 by means of a pair of releasable clamps 76. In this case, the clamps may adopt any form of conventional clamping mechanism. The clamps would also engage the portion of the insert panel over the peripheral side wall 68 and hold the same in tight-fitting retention thereon. Thus, the action of the magnet 72, along with the clamps 76, hold the insert panel on the forming block 66. In this case, the portion of the plastic sheet 40 which surrounds the cut-out 52 is also located over the peripheral surface 68 and retained thereon in the same manner as the insert panel is held.

The retaining fixture 62, which constitutes a second die forming member, is designed to cooperate with the base fixture 60. In this case, the retaining fixture 62 includes a pair of vertically disposed legs which are connected by a horizontally extending arm, or bight, 80. The legs 78 and the horizontal arm 80 are designed to create an enlarged recess designated by reference numeral 82, and which has a size and shape similar to the peripheral surface 68 of the forming block 66. In this case, it can be observed that the legs 78 and connecting arm 80 have an interior engaging surfact 84 which will engage the plastic components on the forming block 66, as previously described.

The legs 78 include upwardly extending sections 86 and a similar upwardly extending section 88 is also formed on the connecting arm 80. In this case, it can be observed that the connecting arm 80 is relatively thin compared to the overall thickness of the legs 78. Again, the upwardly extending sections 86 and 88 are also relatively thick compared to the cross-sectional thickness of the arm 80. This construction is uniquely designed to provide a constant RF, or other form of dielectic heat across the plastic component. The increased thickness of the legs 78 permit the same amount of dielectric energy to be applied at the lower portions of the peripheral surface 68, that is near the base plate 64, inasmuch as these portions are further removed from the source of RF, or other form of dielectric energy. It has been found that the extension 88 on the connecting arm 80 provides the proper amount of RF or other dielectric energy to the connecting arm 80, and the upper extensions 86 provide that necessary amount of dielectric energy to the legs 78 so that the entire face 84 presents a substantially constant amount of dielectric energy across the entire aperture or recess 82.

Thus, there has been illustrated and described a unique and novel form of water bed mattress and the method of making the same and an apparatus used in the making of the same which fulfills all of the objects and advantages sought therefor. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention which is limited only by the following claims.

Having thus described my invention, what I desire to claim and secure by Letters Patent is:

1. An apparatus for use in creating an end construction in waterbed mattresses having a pair of angularly disposed side wall sections joined to one another and to top and bottom walls and which side wall sections and top and bottom walls are formed of a foldable flexible plastic material, said apparatus comprising a first die forming member having a flat wall and a peripheral side wall, said flat wall being sized to receive and retain an insert panel with a portion of said insert panel being folded over to be disposed on a portion of said peripheral side wall and where said panel is pre-cut to conform to the shape of said flat wall and peripheral side wall, said insert panel also being formed of a foldable flexible plastic material, said peripheral side wall having a shape to accommodate the margin of material surrounding a cut-out in one of the side wall sections of said mattress, retaining means to retain said margin of said material and the folded portion of said insert panel on said first die forming member, said retaining means comprising a second die forming member having a size and shape to extend around said peripheral side wall and engage the material and insert panel thereon, said first and second die forming members being constructed of a material to accommodate dielectric energy, said second die forming member having a pair of leg elements connected by a bight element and which bight element is substantially thinner in cross section than each of said leg elements, and means on said second die forming member to receive the dielectric energy and apply same to the folded over portion of said insert panel and said margin of the material.

2. The apparatus of claim 1 further characterized in that the means to retain the margin of said material and folded portion of the insert panel on said die forming member comprises a pair of opposed clamps.

3. The apparatus of claim 1 further characterized in that said second die forming member has a pair of projections extending from said leg elements on the opposite side of said bight element adapted to receive the dielectric energy.

4. The apparatus of claim 3 further characterized in that an additional projection extends from said bight element in essentially parallel relationship to said first-named projections.

5. The apparatus of claim 1 further characterized in that said insert panel has substantially the same overall shape of said cut-out and except for an in-turned flange thereon has substantially the same overall size of said cut-out.

* * * * *